US006543191B1

(12) United States Patent
Kress

(10) Patent No.: US 6,543,191 B1
(45) Date of Patent: Apr. 8, 2003

(54) PREFABRICATED STAIRWAY AND METHOD

(75) Inventor: Russell L. Kress, Rowley, IA (US)

(73) Assignee: Ceramic Technologies Corporation, Rowley, VA (US)

( * ) Notice: Subject to any disclaimer, the term of this patent is extended or adjusted under 35 U.S.C. 154(b) by 0 days.

(21) Appl. No.: 09/711,854

(22) Filed: Nov. 13, 2000

(51) Int. Cl.[7] ..... E04F 11/00
(52) U.S. Cl. ..... 52/182; 52/188; 25/63
(58) Field of Search ..... 52/182, 183, 188, 52/189, 190, 169.7; 25/62, 63, 65

(56) References Cited

U.S. PATENT DOCUMENTS

| | | | | |
|---|---|---|---|---|
| 3,578,110 A | * | 5/1971 | Seagraves | 182/129 |
| 3,830,337 A | | 8/1974 | Todd | |
| 3,952,338 A | | 4/1976 | Troxclair | |
| 3,971,076 A | | 7/1976 | Ahrens | |
| 3,983,205 A | | 9/1976 | Barrett | |
| 4,568,604 A | | 2/1986 | Kurtz et al. | |
| 4,583,334 A | | 4/1986 | Hubbard | |
| 4,589,237 A | | 5/1986 | Dahowski | |
| 4,599,835 A | | 7/1986 | Rinke | |
| 4,706,425 A | | 11/1987 | Brumbalough | |
| 4,783,939 A | * | 11/1988 | Bergmann et al. | 52/188 |
| 4,873,802 A | | 10/1989 | Dahowski | |
| 4,951,434 A | | 8/1990 | Schmidt | |
| 4,985,095 A | * | 1/1991 | Riddle | 52/188 X |
| 5,010,699 A | | 4/1991 | Maiuccoro et al. | |
| 5,347,774 A | | 9/1994 | Smith | |
| 5,448,862 A | | 9/1995 | Candiracci | |
| 5,531,048 A | * | 7/1996 | Darling | 52/188 |
| 5,644,873 A | | 7/1997 | Bourgault | |
| D383,261 S | | 9/1997 | Karsten et al. | |
| 5,688,851 A | | 11/1997 | Kress | |
| 5,794,391 A | | 8/1998 | Howard | |
| 5,872,168 A | | 2/1999 | Katoot | |
| 5,916,098 A | | 6/1999 | Crelin | |
| 5,941,030 A | | 8/1999 | Williamson | |
| 5,951,434 A | | 9/1999 | Richards et al. | |
| 6,067,758 A | | 5/2000 | Zenkner | |

FOREIGN PATENT DOCUMENTS

| | | | | |
|---|---|---|---|---|
| EP | 0061707 | * | 10/1982 | 52/182 |
| EP | 515720 A1 | * | 12/1992 | 52/182 |
| GB | 338361 | * | 11/1930 | 52/182 |

* cited by examiner

*Primary Examiner*—Carl D. Friedman
*Assistant Examiner*—Brian E. Glessner

(57) ABSTRACT

A stairway includes a one-piece fiber reinforced plastic base having a plurality of riser surfaces and tread surfaces forming steps and a landing surface. The tread surfaces and the landing surface are configured to include an integral reinforcement surface region extending along a length of each tread surface and the landing. A preformed plastic tread member is fastened on a respective one of the tread surfaces of the base, and a preformed plastic landing member fastened on the landing surface. The base includes a front wall region, first and second side wall regions and a rear wall region integrally formed as one-piece and includes an outer filled resin layer and a plurality of fiber reinforced filled resin layers.

19 Claims, 14 Drawing Sheets

PREFABRICATED STAIRWAY AND METHOD

FIELD OF THE INVENTION

The present invention relates to a prefabricated stairway for use with a building or other structure.

BACKGROUND OF THE INVENTION

Prefabricated concrete steps have been used to provide access to houses, mobile homes, mobile trailers and other buildings and structures. Such prefabricated concrete steps are heavy and bulky, requiring special equipment to transport and properly position at the building or structure site and can be perceived as unattractive.

An object of the present invention is to provide an improved prefabricated stairway for use with a building or other structure where the stairway is relatively lightweight, requiring no special equipment to facilitate transport and proper positioning at the building or structure site, and yet sturdy enough to withstand loads encountered in use, is resistant to wear, chemicals, and weather, and offers improved stairway aesthetics.

SUMMARY OF THE INVENTION

The present invention provides in one embodiment a stairway comprising a one-piece base having a plurality of riser surfaces and tread surfaces forming steps and an optional landing surface. A preformed tread member is fastened on a respective one of the tread surfaces of the base, and a preformed landing member fastened on the landing surface, if present.

The base preferably comprises a front wall region, first and second sidewall regions and a rear wall region integrally formed with the riser surfaces and tread surfaces as one-piece.

In a preferred embodiment of the invention, the tread surfaces and the optional landing surface are configured to include an integral reinforcement surface region, such as an integral reinforcement rib extending along a length of each tread surface and the landing surface, if present. The reinforcement rib has a concave cross-sectional configuration residing below a plane defined by the respective tread surface and the landing surface. The first and second sidewall regions and rear wall region each include a plurality of integral reinforcement ribs extending from proximate a respective tread or landing surface toward a lowermost decorative skirt of the one-piece base.

The base preferably comprises one or more outer filled resin layers and one or more inner fiber reinforced filled resin layers applied on the outer filled resin layer(s).

The preformed tread members and the landing member preferably comprise of an outer ceramic filled gelcoat layer and a fiber reinforced filled resin layer and are attached to the respective tread surfaces and landing surface using fasteners. The fasteners preferably are captured in part in each tread member and landing member during molding so as to be integral therewith.

The above and other objects and advantages of the invention will become apparent from the following detailed description taken with the following drawings.

DETAILED DESCRIPTION OF THE DRAWINGS

FIG. 10A is an enlarged view of the landing surface anti-slip surface detail.

DETAILED DESCRIPTION OF THE INVENTION

Figure 1:
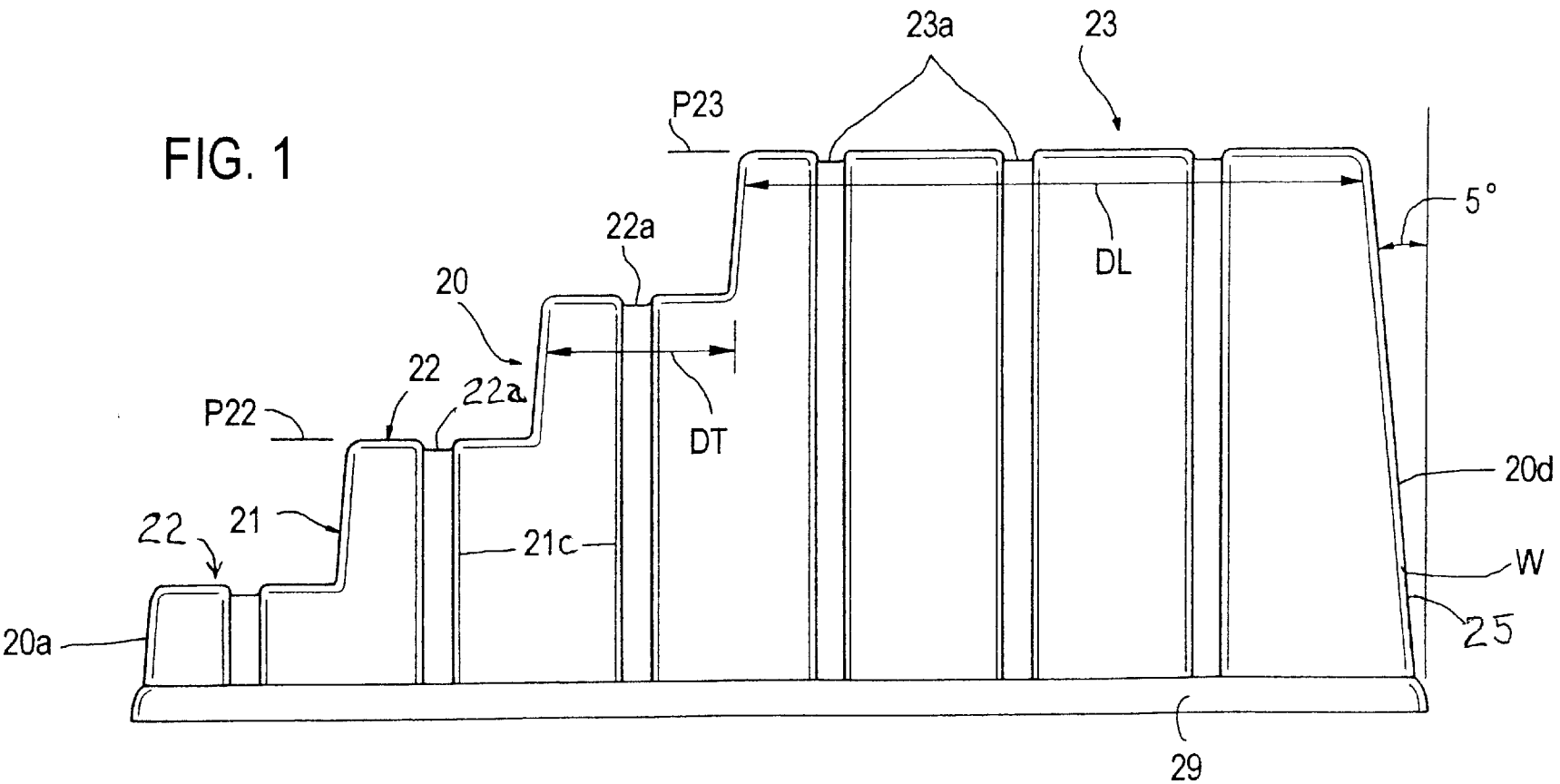
FIG. 1 is an elevational view of a stairway base pursuant to an embodiment of the invention.

Referring to FIGS. 1–10, a prefabricated stairway 10 pursuant to an embodiment of the invention is offered to illustrate the invention but not limit the scope of the invention. The stairway 10 is illustrated as comprising a one-piece base 20 having a plurality of riser surfaces 21 and tread surfaces 22 forming steps and an optional landing surface 23. A preformed tread member 30 is fastened on and overlies a respective one of the tread surfaces 22 of the base 20, and a preformed landing member 40 is fastened on and overlies the landing surface, if present. The stairway is useful to provide access to houses, mobile homes, mobile trailers, mobile classrooms, and other buildings and structures. The presence of the landing surface 23 and landing member 40 is optional since the stairway can be used without these features, if desired for a particular service application.

The base 20 is illustrated as comprising the tread surfaces 22, landing surface 23, front riser wall region 20*a*, first and second side wall regions 20*b*, 20*c* and a rear wall region 20d integrally formed as one-piece. The base 20 has an open bottom defined and bordered by a decorative skirt 29.

The base 20 can be made by spraying in a first step, a first outer filled resin layer 25 (FIG. 6) using a filled resin system #1 as described in Table #1 through a commercially available two-chamber spray gun (e.g. PRO Series spray gun from manufacturer, Venus Gusmer Inc.) having a static mixer of sufficient length to thoroughly mix filled resin system #1 with a methyl ethyl ketone peroxide catalyst (e.g. High Point 90 by Witco Corporation) as it is sprayed on the surface of a mold. This mixture (i.e. resin system #1 and catalyst) is then allowed to polymerize or cure. The filled resin system #1 (step 1) is sprayed to form outer filled resin layer 25 to have a nominal thickness of about 0.030 inch. Although spraying is the preferred method of application, filled resin system #1 can be hand catalyzed, mixed, and then brushed on or poured on the surface of the mold and allowed to polymerized or cure.

Figure 6:
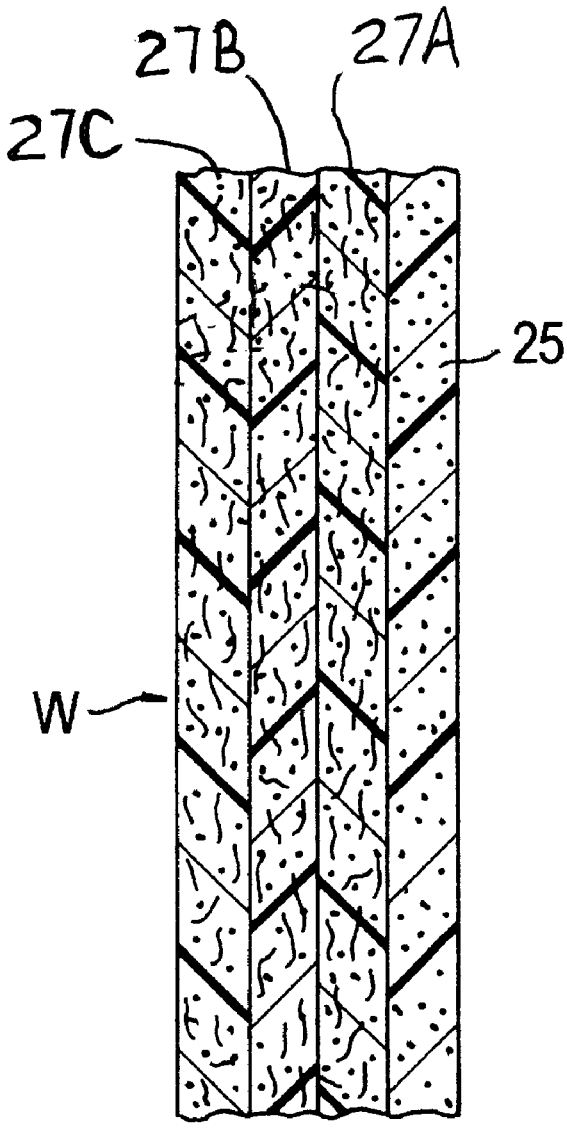
FIG. 6 is an enlarged partial cross-sectional view of the sprayed wall of the stairway base.

After the aforementioned mixture forming outer filled resin layer 25 has cured, a step 2 involves spraying a second layer 27A behind the first layer 25. The second layer 27A is formed by spraying the resin system #1 as described above on layer 25 immediately followed by spraying filled resin system #2 as described in Table II and chopped fiberglass fibers through a two-chamber gun of the type described above having a static mixer of sufficient length to thoroughly mix filled resin system #2 with the above catalyst as it is sprayed. This spray gun is also be equipped with a conventional chopper head available from the above manufacturer to cut the fiberglass gun roving into 1" lengths. Both the chopped fibers and the filled resin system #2 are simultaneously sprayed behind the filled resin system #1 at a preferred ratio of 70% by weight of resin and 30% by weight of chopped fiberglass. The mixture is then rolled out and allowed to polymerize or cure to form fiber reinforced filled resin layer 27A. Step #2 described above is repeated twice more to form fiber reinforced filled resin layers 27B and 27C. Each fiber reinforced filled resin layer 27A, 27B, 27C has a nominal thickness of about 0.060 inch. The total thickness of the wall W of base 20 thus is about 0.21 inch, although other base wall thicknesses can used in practice of the invention. A cross-section through the wall W of the one-piece base 20 is shown in FIG. 6.

Table I

Resin System #1

Filed resin system #1 comprises a mixture consisting of 50% by weight of a synthetic resin selected from the polyester or vinyl ester group, (although other resins may be found suitable), 46% by weight of a wollastonite based product as described in U.S. Pat. No. 4,568,604 and sold under the trademark "KZ6" by Ceramic Technologies Corporation of Rowley Iowa, 2% by weight of the mineral Talc, 1% by weight of a hollow microsphere sold under the trademark "Dualite" by Pierce and Stevens Corporation of Buffalo N.Y., and 1% by weight Titanium Dioxide. It will be understood by those skilled in the art that the above mixture has been found to be preferred but that deviation from the percents listed or the filler or other constituents used is within the scope of this invention.

Table II

Resin System #2

Resin system #2 comprises a mixture consisting of 75% by weight of a synthetic resin selected from the polyester or vinyl ester group, (although other resins may be found suitable), 21 ½% by weight of a wollastonite based product as described in U.S. Pat. No. 4,568,604 and sold under the trademark "KZ9" by Ceramic Technologies Corporation of Rowley Iowa, 2% by weight of the mineral Talc, ½% by weight of a hollow microsphere sold under the trademark "Dualite" by Pierce and Stevens Corporation of Buffalo N.Y., and 1% by weight Titanium Dioxide. It will be understood by those skilled in the art that the above mixture has been found to be preferred but that deviation from the percents listed or the filler or other constituents used is within the scope of this invention.

It will be noted that the filled resin system #1 and filled resin system #2 each contain the catalyst described above so that the layers 25, 27A, 27B, 27C comprising the base 20 cure on the mold without the need for heating to this end.

Figure 11:
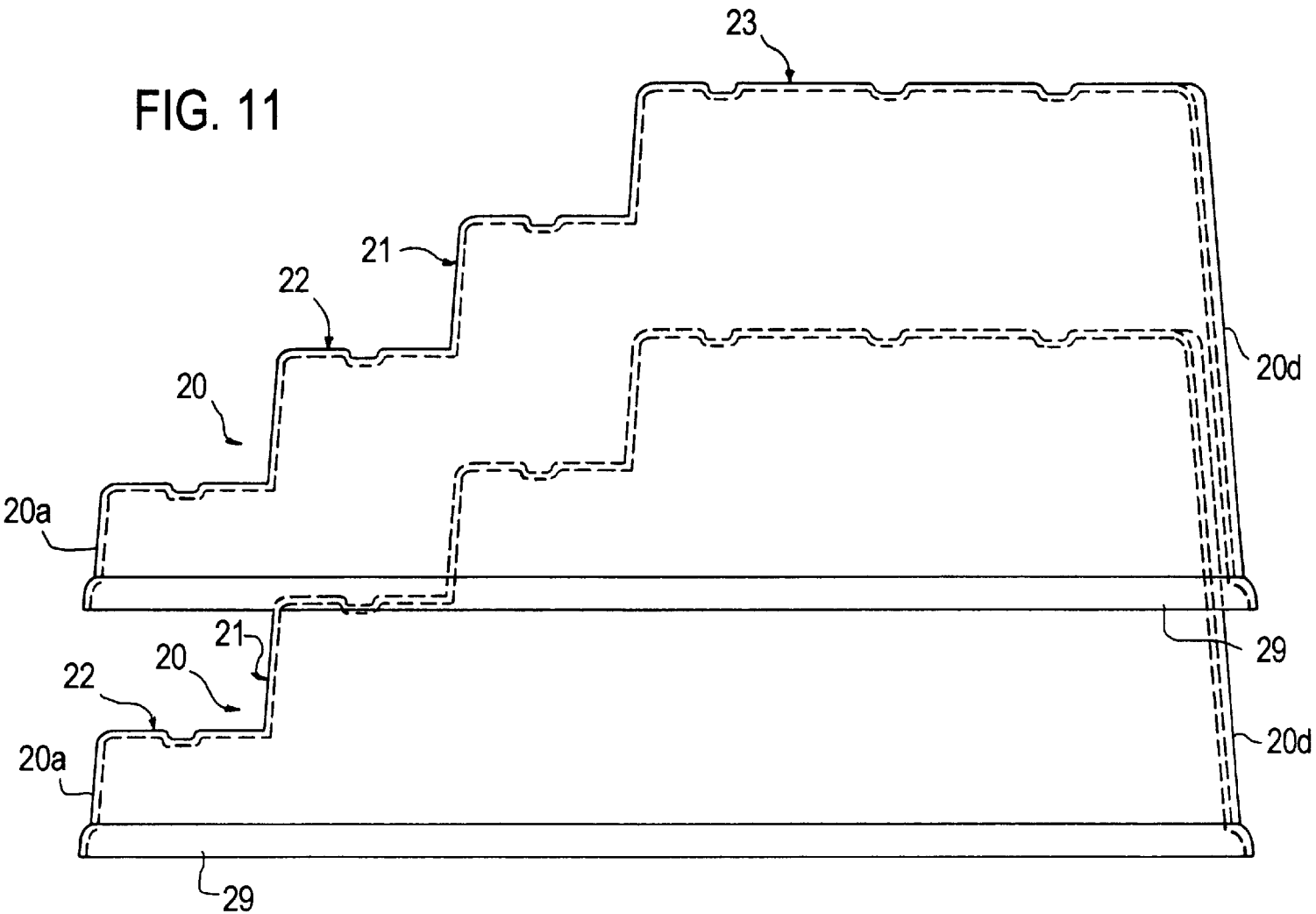
FIG. 11 is a sectional view of two stairway bases of the invention nested together for transport or storage.
Figure 12:
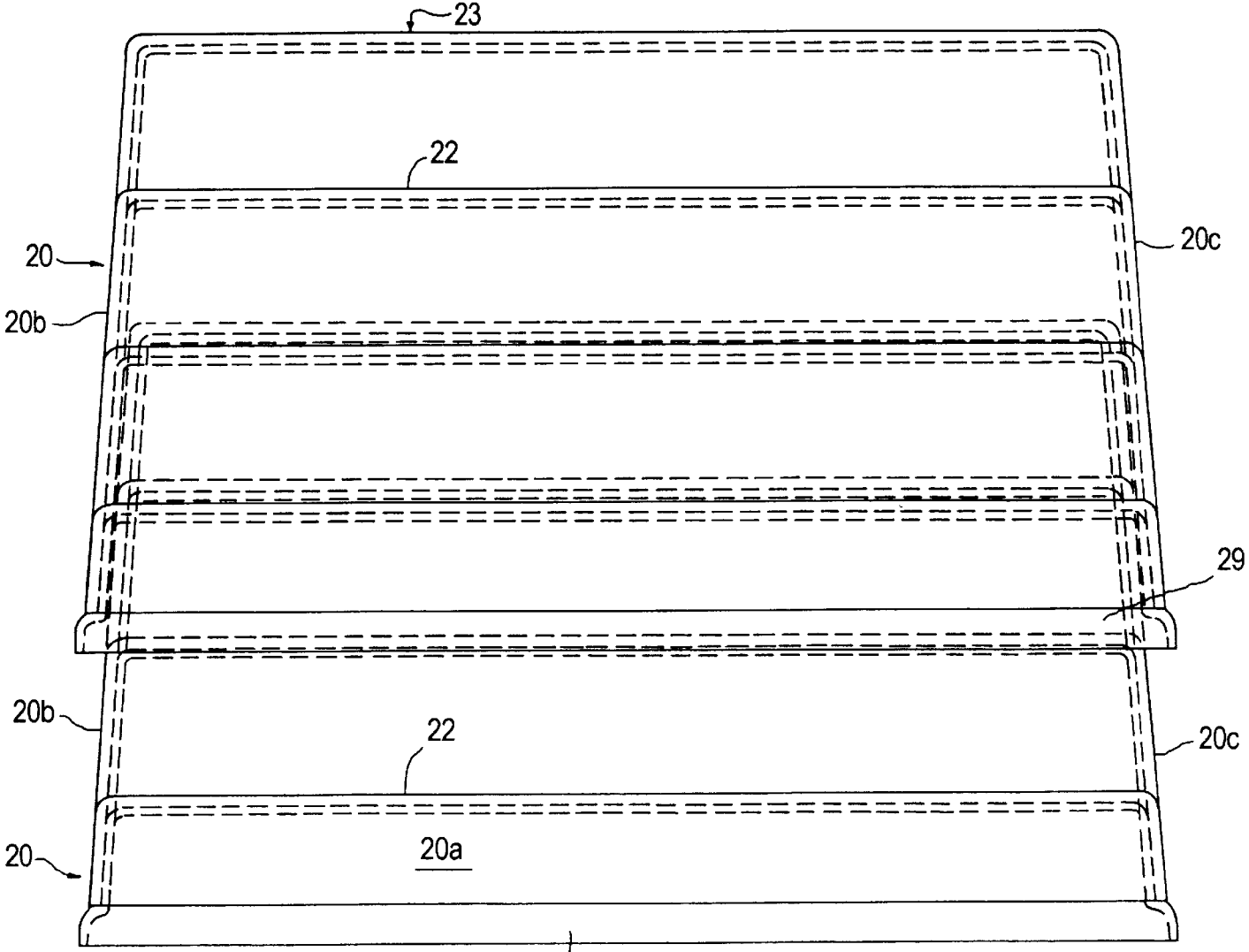
FIG. 12 is a front elevation of two bases nested together.
Figure 13:
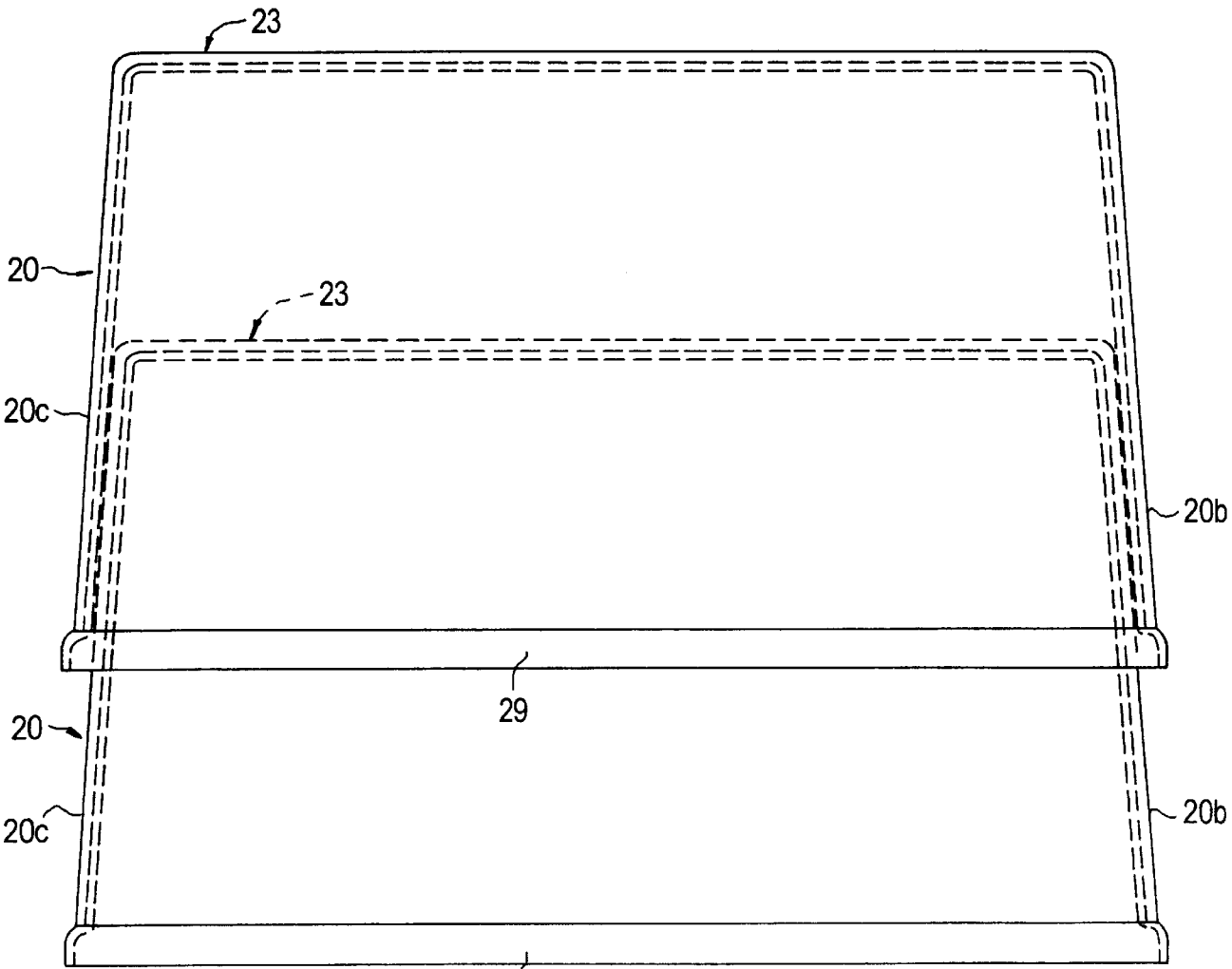
FIG. 13 is a rear elevation of two bases nested together.

The resin system #1 without chopped fibers and resin system #2 with chopped fiberglass fibers as described above are sprayed on a one piece, open-bottom master mold (not shown). The master mold is fabricated of the same material layers as described above sprayed on a master wooden pattern having a shape corresponding to that of the stairway base 20. The fabricated master mold is provided with a draft angle of 5 degrees (or other suitable draft angle) that is imparted to the base 20 as a 5 degree top-to-bottom draft angle on each of the front riser wall region 20*a,* first and second side wall regions 20*b,* 20*c* and rear wall region 20*d* illustrated for rear wall region 20*d* in FIG. 1. This draft angle allows the sprayed, cured base 20 to be removed vertically from the mold out of the open bottom of the mold, the base 20 being sprayed with the tread surfaces 22 and landing surface 23 oriented to face downwardly. This draft angle renders the bases 20 nest-able one atop the other as illustrated in FIGS. 11, 12, and 13, for storage and transport. A wooden or other shim (not shown) can be provided to support the front wall regions 20*a* of the bases 20 to orient the bases 20 in a level (horizontal) orientation when they are nested.

Figure 2:
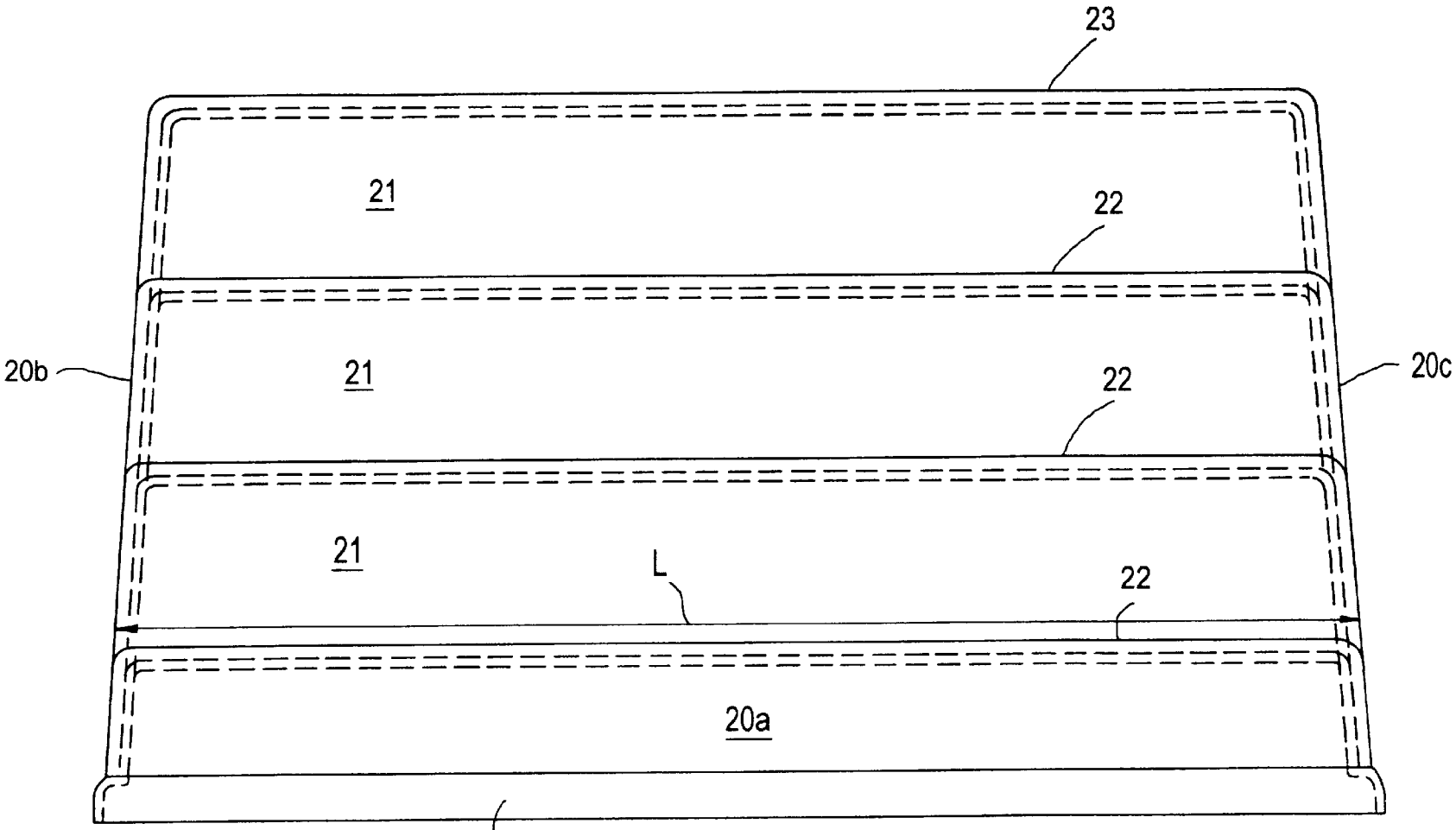
FIG. 2 is a front elevation of the stairway base.
Figure 3:
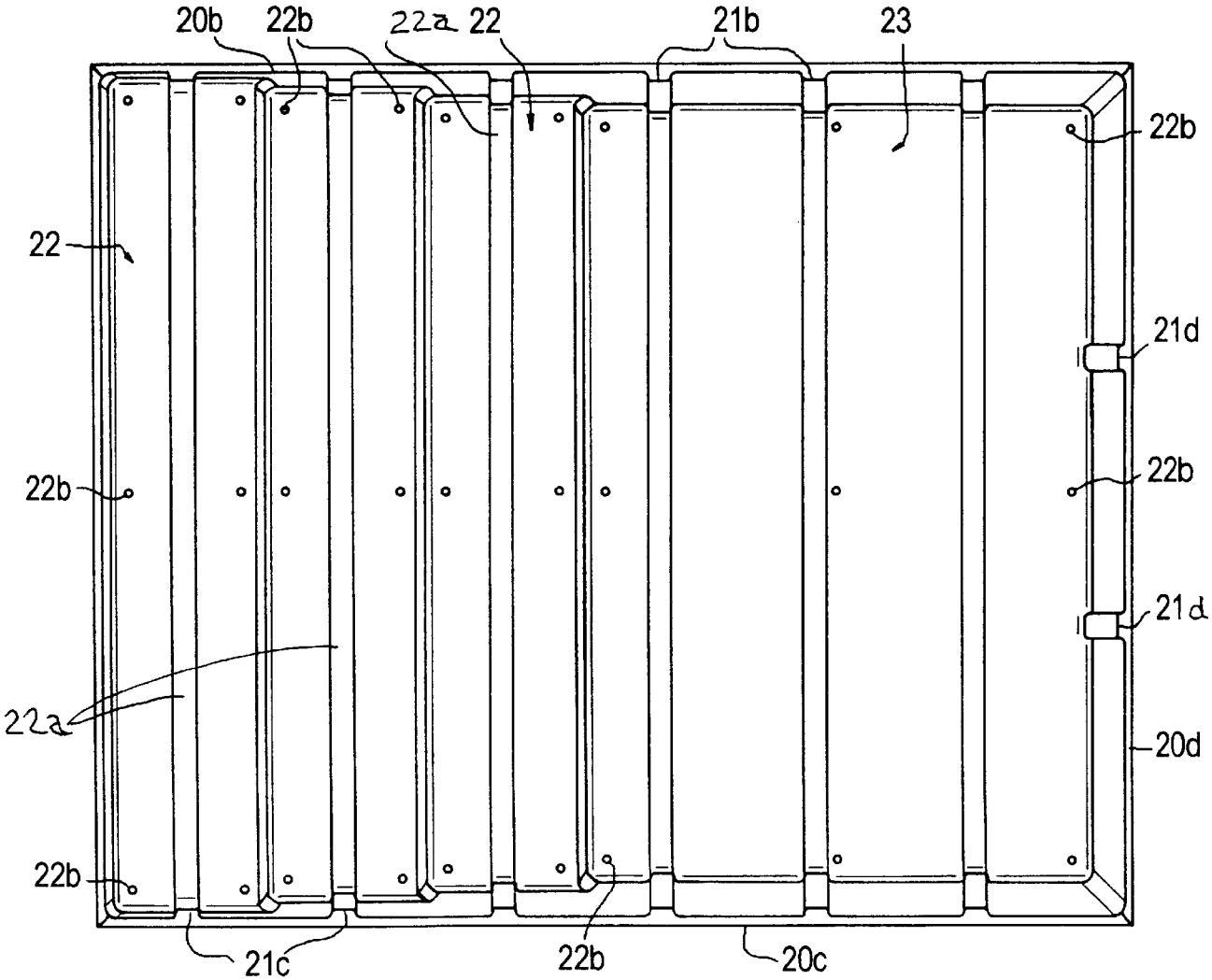
FIG. 3 is a plan view of the stairway base.

The tread surfaces 22 and the landing surface 23 are generally flat and horizontal with the exception that they are configured to include an integral reinforcement surface region, such as an integral reinforcement rib 22*a* and 23*a* extending along a length dimension L of each tread surface 22 and landing 23, FIG. 2. The reinforcement ribs 22*a,* 23*a* have a concave cross-sectional configuration residing below a plane P22 and P23 defined by the tread surface 22 and the landing surface 23, respectively. Each tread surface 22 is illustrated having one reinforcement rib 22*a* generally centrally located on the tread surface, while the landing surface 23*a* is illustrated as having three reinforcement ribs 23*a* generally equally spaced on the landing surface. The number of integral reinforcement ribs 22*a,* 23*a* can be varied as desired in practice of the invention. The integral reinforcement ribs 22*a,* 23*a* are formed during the resin spraying operation described above simply by providing the tread-forming surfaces and landing-forming surfaces of the master mold with rib-forming raised projections.

The tread surfaces 22 and landing surfaces 23 also include a plurality of holes 22*b* that are adapted to receive fasteners 28 on the tread members and landing members. The holes 22*b* are formed in the tread surface and landing surface by first molding a dimple and then drilling once base 20 is removed from the mold. For purposes of illustration only, the holes 22*b* are formed in a pattern or array shown in FIG. 3 to receive the fasteners 28 of the tread member 22 and landing member 23.

Figure 14:
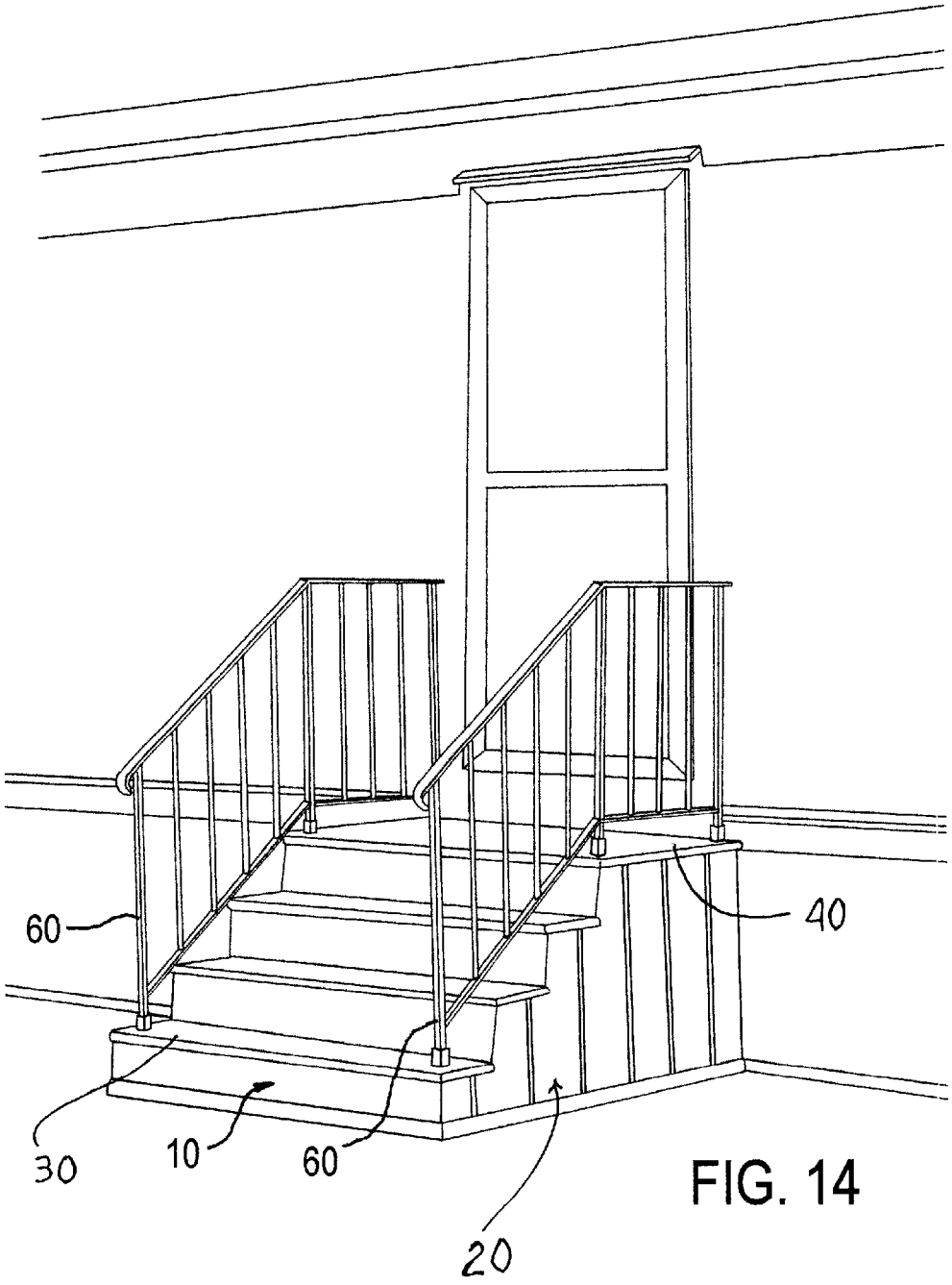
FIG. 14 is a perspective view of a stairway pursuant to an embodiment of the invention positioned on the ground next to a mobile home with a hand railing shown attached on each side of the stairway.

The first and second side wall regions 20*b,* 20*c* and rear wall region 20*d* each also include a plurality of upright integral reinforcement ribs 21*b,* 21*c,* 21*d* extending from proximate a respective tread surface 22 toward a lowermost edge of the base 20 defined by an integral decorative outwardly flared skirt 29 that rests on the ground, FIG. 14, concrete or gravel pad, or other support when the stairway is placed adjacent a building or structure. The upright reinforcement ribs 21*b,* 21*c,* 21*d* of the side wall regions 20*b,* 20*c* and rear wall region 20*d* are similar in configuration and manner of formation on the mold during the resin spraying operation as the reinforcement ribs 22*a,* 23*a* described above.

The dimensions of the tread surfaces 22 and landing surface 23 can be selected as desired for a particular construction application. The tread surfaces 22 typically are of equal depth dimension DT from one tread surface to the next. The landing surface 23 typically has a depth dimension DL that is larger than the depth dimension DT of the tread surfaces 22 with the depth dimension selected at any value as desired for a particular building construction application.

Figure 4:
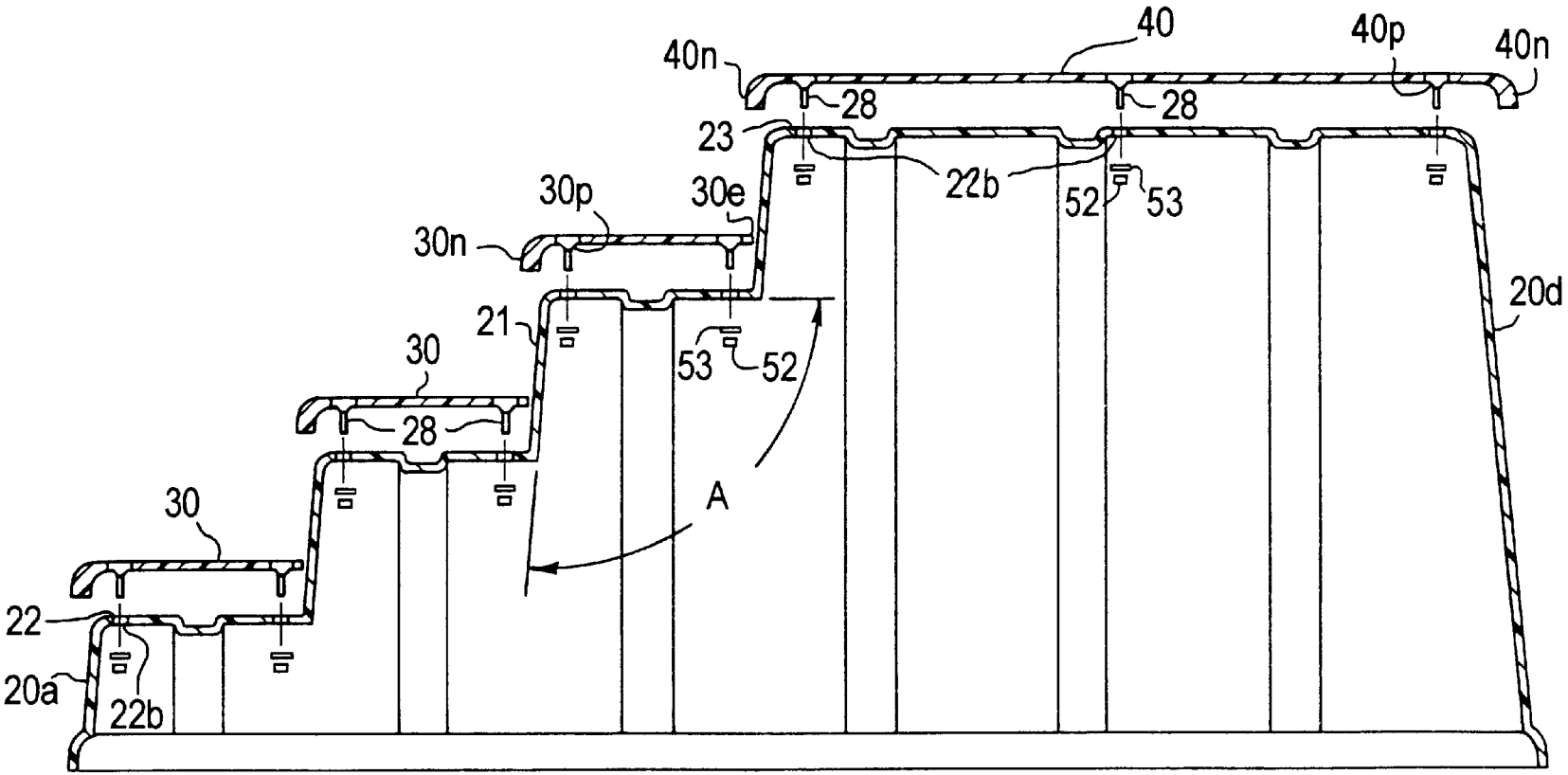
FIG. 4 is an exploded sectional view of a stairway pursuant to an embodiment of the invention showing the base of FIG. 1 with tread members, landing member, and fasteners.

The riser surface 21 and adjacent tread surface 22 define an included angle A, FIG. 4, that can be 95 degrees for purposes of illustration but not limitation as other included angles A can be used.

Figure 5:
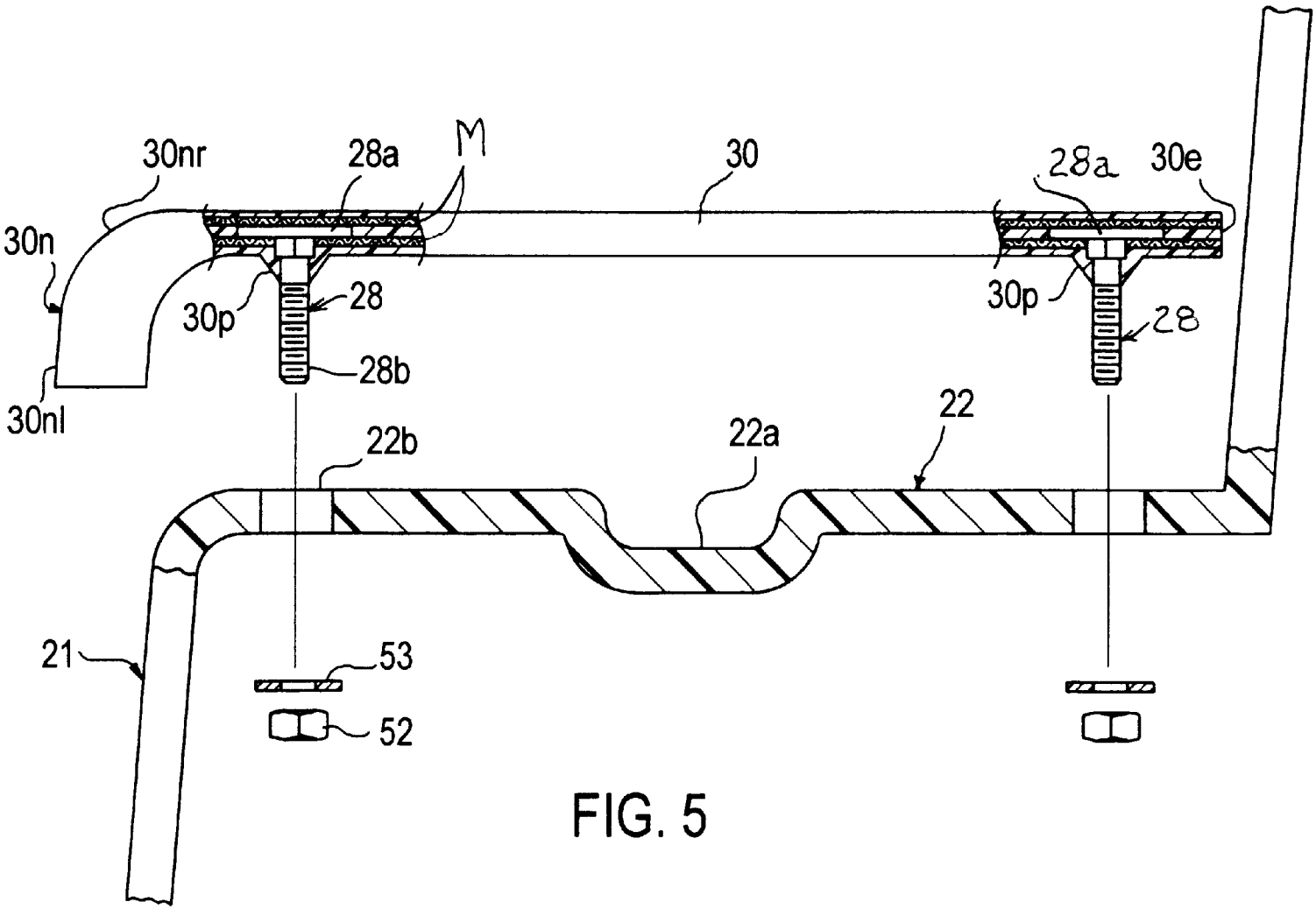
FIG. 5 is an enlarged exploded sectional view of a riser and tread region of the base showing the tread member with integral fasteners.

The preformed tread members 30 and the landing member 40 typically are molded by applying (e.g. spraying, brushing and the like) a product sold under the trademark "KZ Ceramic Gelcoat", and taught in U.S. Pat. No. 5,688,851, herein called "KZ Gelcoat", mixed with the above catalyst and applied to the surface of a face-mold of a two-part mold and allowed to polymerize or cure to provide a layer nominal thickness of about 0.030 inch. Then, multiple layers (usually 2 to 4) of continuous fiberglass mat M, FIG. 5, are placed in the face-mold behind the cured "KZ Gelcoat", the mold is then closed by clamping, bolting or otherwise connecting a rear-mold to the face-mold and filled with the above filled resin system #2 mixed with the above catalyst and allowed to polymerize or cure. The thickness of each tread member 30 and landing member 40 is nominally about 0.20 inch.

The tread members 30 and landing members 40 can be individually molded in a conventional two-part cavity mold comprising a face-mold and rear-mold mate-able to form a closed cavity, such as is used in RTM (Resin Transfer Molding) or compression molding. Other molding techniques, which can be used, include but are not limited to injection molding, low pressure composite molding, and other conventional molding processes.

The tread members 30 and landing member 40 are molded to capture integrally therein a plurality of threaded fasteners 28 each having enlarged fastener head 28*a* and a threaded shank 28*b,* FIG. 5. The fasteners 28 are captured in each tread member by placing the head of the fastener between the aforementioned layers of the fiberglass mats M before molding. Capturing of the fasteners 28 in this manner is advantageous to hide the fasteners from view when the stairway 10 is assembled.

The tread members 30 and the landing member 40 are molded to include integral pilot protrusions 30*p* and 40*p* on the underside thereof and adapted to be received in a respective hole 22*b* in the underlying tread surface 22 and landing surface 23.

Figure 7:
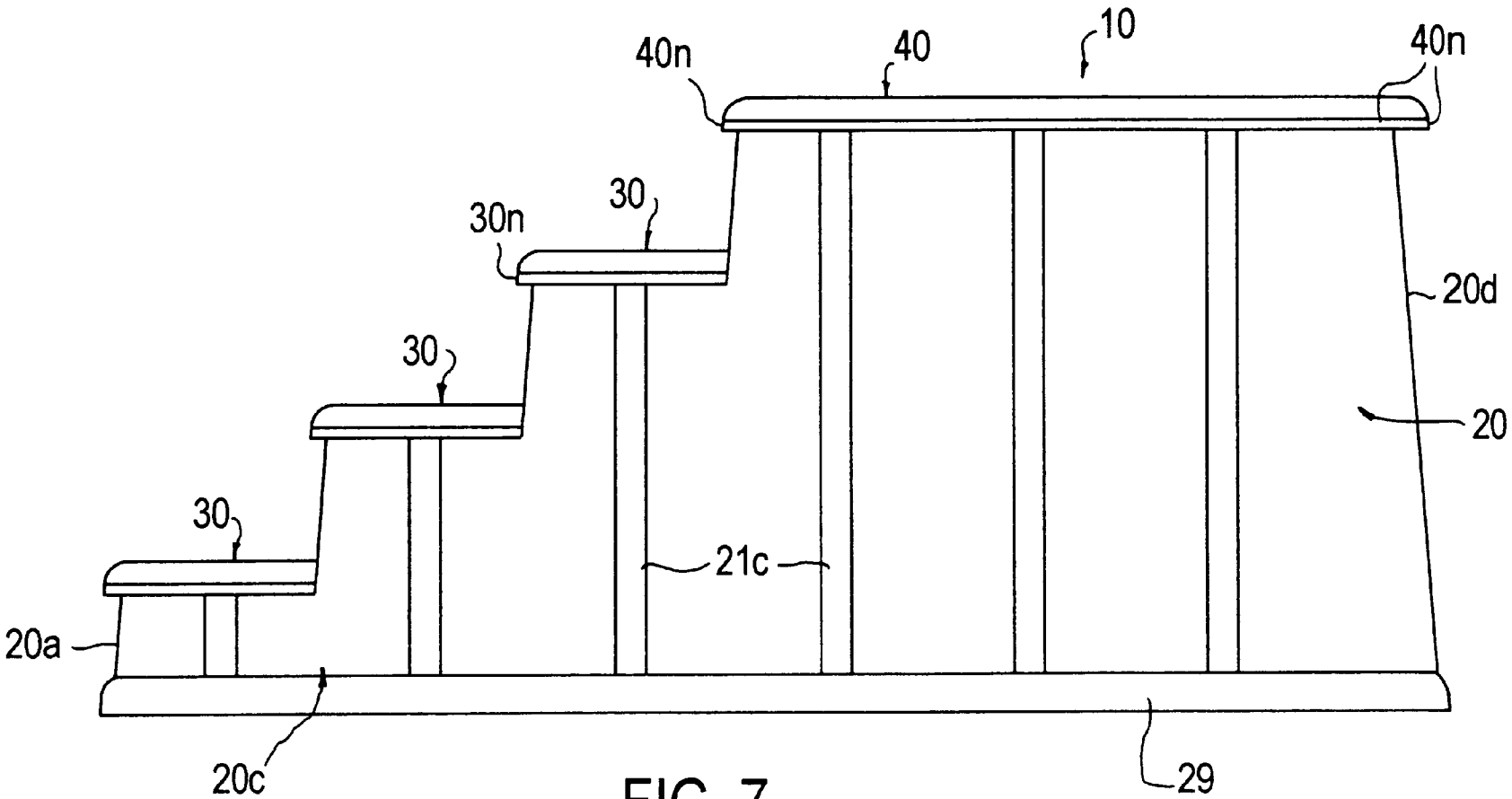
FIG. 7 is a side elevation of a stairway pursuant to an embodiment of the invention after the tread members and landing members are fastened on the base.
Figure 8:
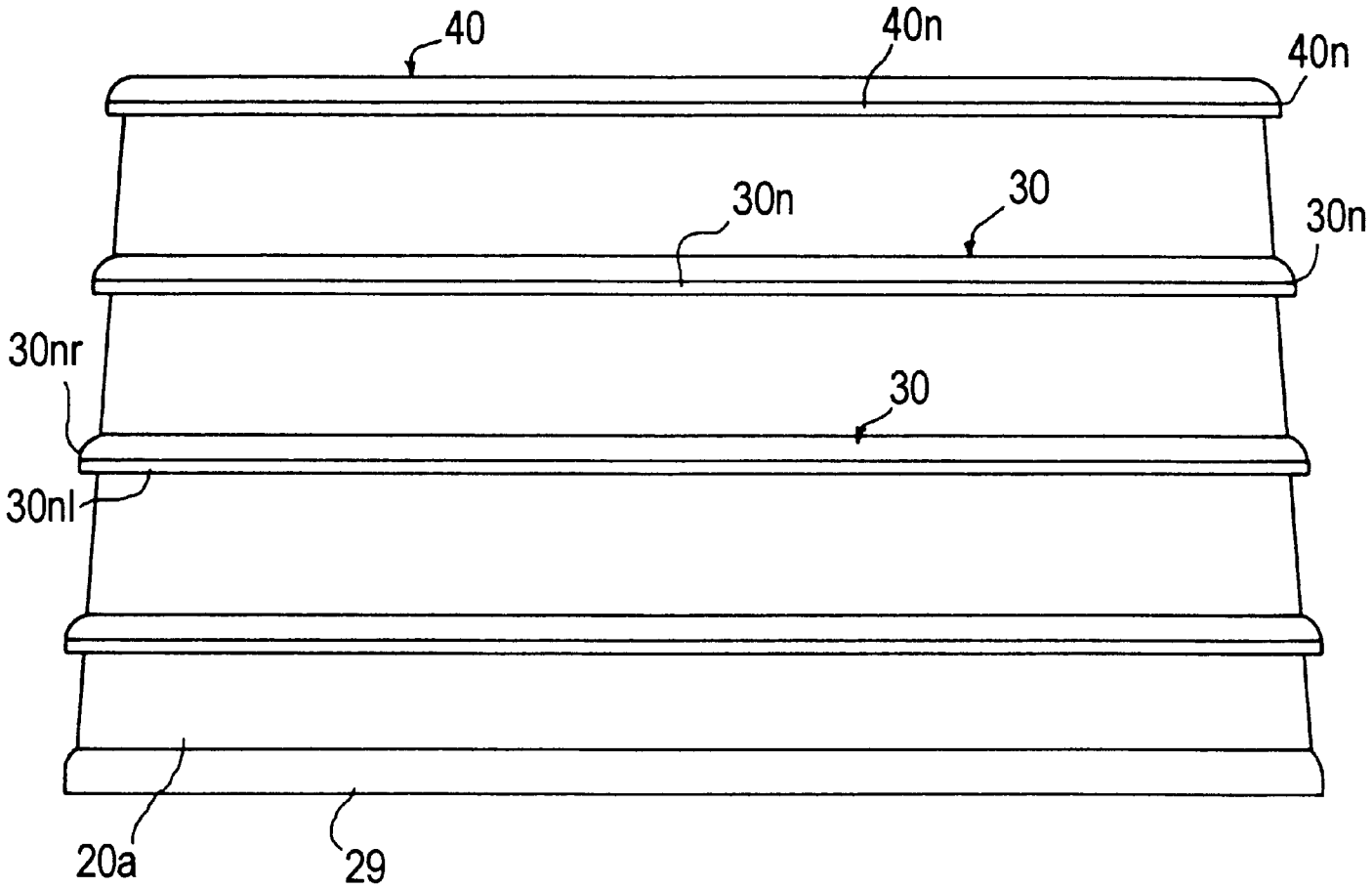
FIG. 8 is a front elevation of the stairway of FIG. 7.
Figure 9:
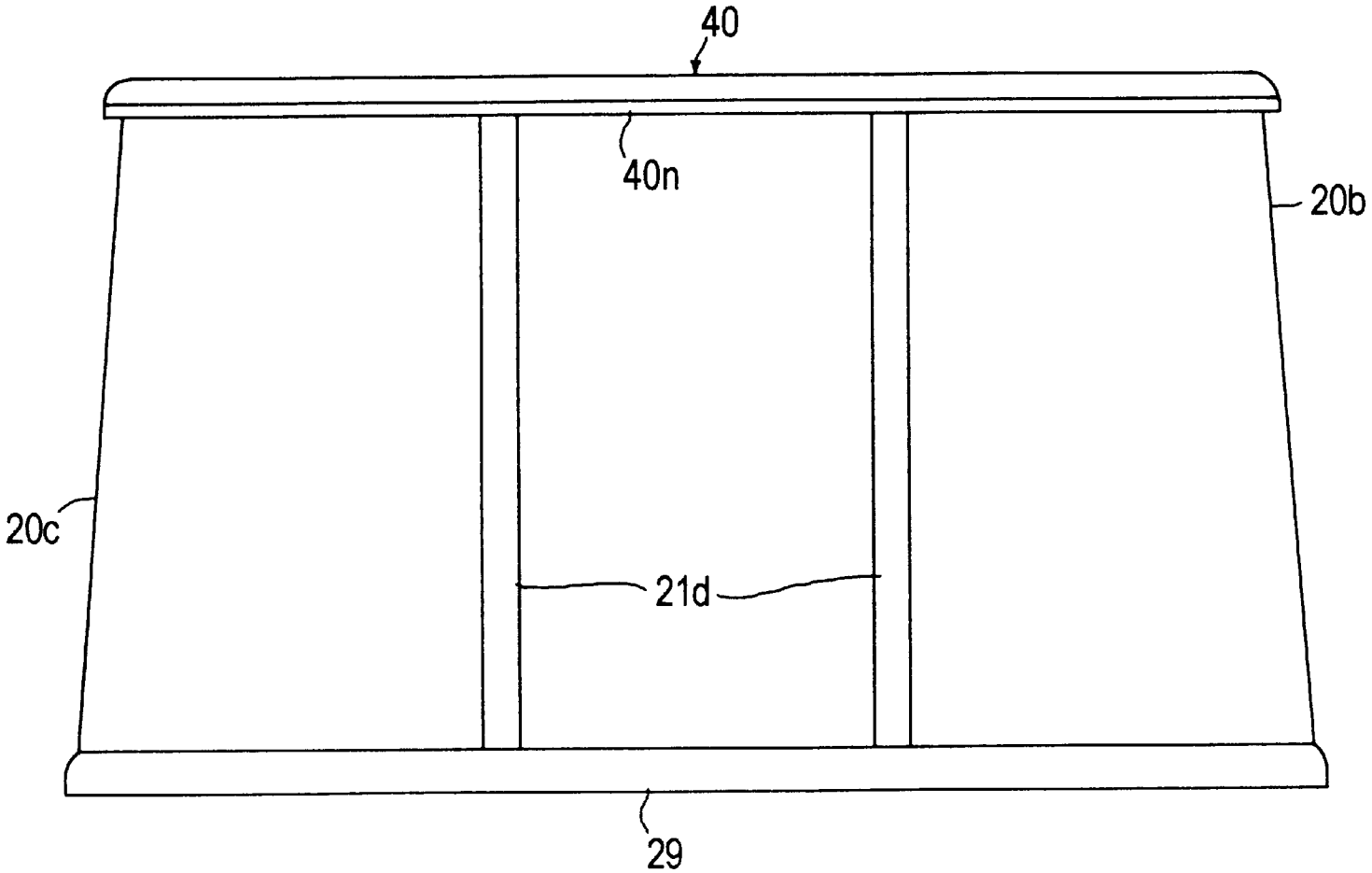
FIG. 9 is a rear elevation of the stairway of FIG. 7.
Figure 10:
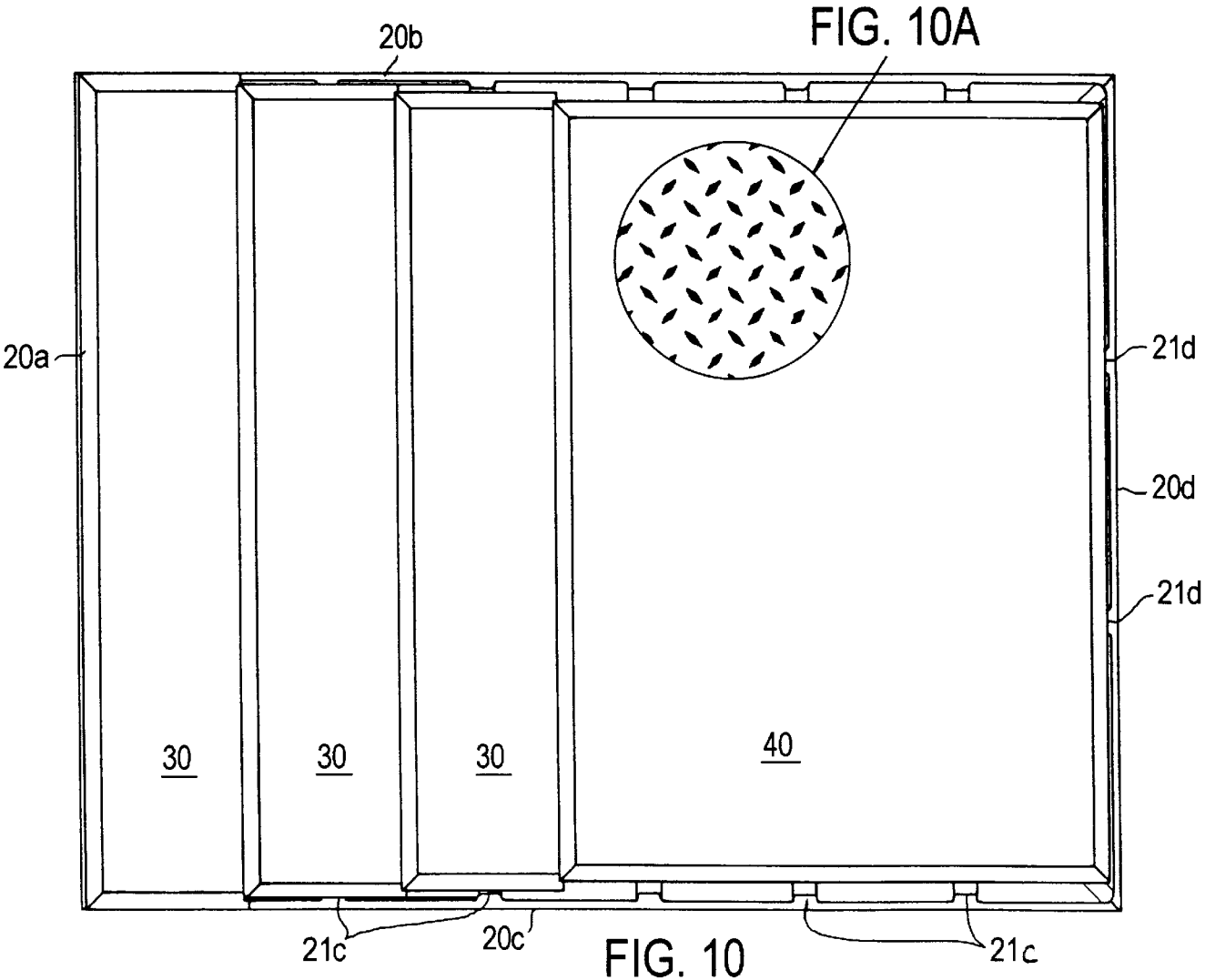
FIG. 10 is a plan view of the stairway of FIG. 7.

The tread members 30 are also molded to include an integral bull nose 30*n* that depends or extends downwardly about the front and side periphery (but not the rear periphery) of the tread member to overlap and hide the adjacent riser surface 21 located therebelow and the side wall regions 20*b,* 20*c* as will be appreciated from FIG. 4 and FIGS. 7–8. The rear periphery of each tread member 30 comprises a straight edge 30*e*. The bull nose 30*n* includes a straight lip region 30*nl* and a radius region 30*nr*.

The landing member 40 is also molded to include an integral bull nose 40*n* that depends or extends downwardly about the entire periphery of the landing member to overlap and hide the adjacent riser surface 21 located therebelow, the side wall regions 20*b,* 20*c* and the rear wall region 20*d* as will be appreciated from FIG. 4 and FIGS. 7–9.

The bull noses 30*n* and 40*n* on the tread members 30 and landing member 40 provide an aesthetically pleasing appearance to the stairway when assembled.

The tread members 30 and the landing member 40 are fastened to the respective tread surfaces 22 and landing surface 23 by inserting the threaded shank 28*b* of the fasteners 28 through the holes 22*b* and assembling and tightening a nut 52 on the shank 50*b* with a washer 53 positioned between the nut 52 and the underside of the tread member and the landing member, FIG. 4.

The tread members 30 and the landing member 40 can be molded to provide an anti-slip surface on the upper surface thereof. FIG. 10A illustrates a partial enlarged view a molded diamond anti-slip surface pattern for purposes of illustration only that can be molded into the entire upper surface of the landing member 40 and the tread members 30 if desired. Other anti-slip surfaces can be molded into the upper surfaces of the tread members and/or the landing member to suit a particular construction application. Moreover, the tread members 30 and landing member 40 can be molded to impart any desired decorative appearance thereto. For example, they can be molded to have a stone, brick or other desired surface appearance. Still further, the color of the tread members and the landing member can be selected to provide any desired aesthetic appearance. For example, the color of the tread members 30 and landing member 40 can be different from that of the base 20 and matched to the color of the building or structure.

In use, should a tread member 30 or the landing member 40 become damaged for some reason, it can be removed from the stairway 10 by removing the nuts 52 and then fastening a replacement tread member or landing member in its place.

The stairway 10 can have railings 60 conventionally attached to opposite sides thereof as depicted in FIG. 14. Moreover, the stairway can be lighted and/or heated as desired by addition of conventional lights or heating elements (not shown). House numbers can be attached to the stairway. The space below the stairway is protected from the weather and can be used for storage or other purposes.

The present invention is advantageous to provide an improved prefabricated stairway for use with a building or other structure where the stairway is relatively lightweight to facilitate transport to and proper positioning at the building or structure site and yet sturdy enough to withstand loads encountered in use, is resistant to wear, chemicals, and weather, and offers improved stairway aesthetics.

Although the invention has been described with respect to certain specific embodiments, it is not limited thereto and can be modified and changed within the scope of the appended claims.

I claim:

1. Stairway, comprising a one-piece base having a plurality of riser surfaces and tread surfaces forming steps, said tread surfaces including holes therein, and a plurality of individual preformed removable, one-piece tread members with a respective individual tread member fastened on a respective one of said tread surfaces of said base by fasteners each received in a respective one of said holes.

2. The stairway of claim 1 including a landing surface including holes therein and a preformed removable, one-piece landing member fastened on said landing surface by fasteners each received in a respective one of said holes.

3. The stairway of claim 1 wherein each said tread surface includes an integral reinforcement tread surface region generally centrally located on said tread surface.

4. The stairway of claim 3 wherein the reinforcement tread surface region comprises an integrally molded reinforcement rib extending along a length of each said tread surface and having an upwardly open, concave cross-sectional configuration residing below a plane defined by said tread surface.

5. The stairway of claim 2 wherein said landing surface includes an integral reinforcement landing surface region extending across said landing surface.

6. The stairway of claim 5 wherein the reinforcement landing surface region comprises an integrally molded reinforcement rib extending along a length of said landing surface and having an upwardly open concave cross-sectional configuration residing below a plane defined by said landing surface.

7. The stairway of claim 1 wherein said base comprises a front wall region, first and second side wall regions and a rear wall region integrally formed as one-piece.

8. The stairway of claim 7 wherein said first and second side wall regions each include a plurality of integrally molded reinforcement ribs extending from proximate a respective tread surface toward a lowermost edge of said side wall regions and having an outwardly open, concave cross-sectional configuration below a plane defined by a respective one of said side wall regions.

9. The stairway of claim 7 wherein said front wall region, said first and second side wall regions and said rear wall region comprise at least one outer filled resin layer and at least one fiber reinforced filled resin layer applied on said filled resin layer.

10. The stairway of claim 9 wherein said at least one outer filled resin layer comprises a synthetic resin and mineral particles and said at least one fiber reinforced filled resin layer comprises a resin, mineral particles and chopped fibers.

11. The stairway of claim 1 wherein said preformed tread members comprise an outer ceramic filled gelcoat layer and a fiber reinforced filled resin layer on said gelcoat layer.

12. The stairway of claim 1 wherein said preformed tread members each includes an integral bull nose that depends downwardly to overlap the adjacent riser surface located therebelow.

13. The stairway of claim 1 wherein a lower surface of each said preformed tread member includes a plurality of pilot protrusions each received in a respective one of said holes in said tread surface.

14. The stairway of claim 1 wherein said fasteners each include an enlarged fastener head captured in a respective tread member and hidden below an upper surface of each respective tread member and a threaded shank extending below each respective tread member and received in a respective hole of a respective tread surface.

15. The stairway of claim 2 wherein said preformed landing member comprises an outer ceramic filled gelcoat layer and a fiber reinforced filled layer on the gelcoat layer.

16. The stairway of claim 2 wherein said preformed landing member includes an integral bull nose that depends downwardly to overlap the adjacent riser surface located therebelow.

17. The stairway of claim 2 wherein said fasteners each include an enlarged fastener head captured in said landing member and a threaded shank received in a respective hole of said landing surface.

18. The stairway of claim 2 wherein a lower surface of said preformed landing member includes a plurality of pilot protrusions that are received in a respective one of said holes in the underlying landing surface.

19. The stairway of claim 1 wherein said base includes an outwardly flared skirt about a lowermost edge thereof.

* * * * *